US011976400B2

(12) United States Patent
Tuniki et al.

(10) Patent No.: US 11,976,400 B2
(45) Date of Patent: May 7, 2024

(54) WASHING MACHINE APPLIANCE AND A REMOVABLE AGITATOR THEREFOR

(71) Applicant: Haier US Appliance Solutions, Inc., Wilmington, DE (US)

(72) Inventors: Sanjana Tuniki, Hyderabad (IN); Neki Jashwant Patel, Hyderabad (IN); Sanjay Yadav Majjath, Hyderabad (IN); Jay Pareshbhai Shinde, Hyderabad (IN); Sasikumar Durairaj, Hyderabad (IN)

(73) Assignee: Haier US Appliance Solutions, Inc., Wilmington, DE (US)

( * ) Notice: Subject to any disclaimer, the term of this patent is extended or adjusted under 35 U.S.C. 154(b) by 608 days.

(21) Appl. No.: 17/188,027

(22) Filed: Mar. 1, 2021

(65) Prior Publication Data

US 2022/0275553 A1 Sep. 1, 2022

(51) Int. Cl.

| | |
|---|---|
| ***D06F 13/02*** | (2006.01) |
| ***D06F 17/10*** | (2006.01) |
| ***D06F 23/04*** | (2006.01) |

(52) U.S. Cl.

CPC ..... *D06F 13/02* (2013.01); *D06F 17/10* (2013.01); *D06F 23/04* (2013.01)

(58) Field of Classification Search

None

See application file for complete search history.

(56) References Cited

U.S. PATENT DOCUMENTS

| | | | | |
|---|---|---|---|---|
| 3,641,791 | A | 2/1972 | Jacobsen | |
| 3,648,486 | A | 3/1972 | Rosinski | |
| 4,193,275 | A | 3/1980 | Bochan | |
| 10,787,761 | B2 | 9/2020 | Czarnecki | |
| 2019/0062978 | A1* | 2/2019 | Czarnecki | D06F 37/12 |

FOREIGN PATENT DOCUMENTS

| | | | |
|---|---|---|---|
| CN | 203530690 | U | 4/2014 |
| ES | 279099 | A3 | 11/1962 |
| KR | 100556483 | B1 | 3/2006 |

* cited by examiner

*Primary Examiner* — Levon J Shahinian

(74) *Attorney, Agent, or Firm* — Dority & Manning, P.A.

(57) ABSTRACT

A washing machine appliance or agitator may include an impeller base and an extended post. The impeller base may be rotatably mounted within and define a rotation axis. The impeller base may include a mounting face with one or more dovetail joints. The extended post may be removably attached to the impeller base to rotate therewith. The extended post may include a base body base body extending along the rotation axis between a bottom end proximal to the impeller base and a top end distal to the impeller base. The extended post may also include an auger fin extending radially from the base body between the bottom end and the top end. The extended post may further include a mating face disposed on the bottom end. The mating face may define one or more receiver slots corresponding to and selectively receiving the one or more dovetail joints.

20 Claims, 8 Drawing Sheets

WASHING MACHINE APPLIANCE AND A REMOVABLE AGITATOR THEREFOR

FIELD OF THE INVENTION

The present subject matter relates generally to washing machine appliances and an agitation element for the same.

BACKGROUND OF THE INVENTION

A vertical axis washing machine appliance generally includes a tub with a basket rotatably positioned within the tub. Articles to be washed, such as clothes, are placed in the machine's basket. An agitation element can be included in the tub, and can rotate to move articles within the basket to facilitate washing. Agitation elements are typically impellers, single-action agitation elements, or dual-action agitation elements. Generally, such an agitation element reciprocates about a rotation axis (e.g., vertical axis) within the machine's basket. In some instances, fins extend from a rigid shaft of the agitation element to contact and move the articles. The surface of the basket and gravity may be used in conjunction with such agitation elements to impart a circular motion of the articles, known as "turnover," from a top of the basket, to a bottom of the basket, and back up to the top of the basket.

Different agitation elements typically come with different advantages and disadvantages. In the case of single-action and dual-action agitation elements, users may perceive greater agitation and turnover of articles during a washing operation or cycle than with an impeller agitation element. In the case of impeller agitation elements, a greater volume or portion of the wash basket may be available or better able to handle bulky items (e.g., towels, bedding, etc.) than a single-action or dual-action agitation element.

Generally, a consumer or user has to decide which type of agitation element would be most desired at the time of purchase. This obviously limits the user's choice and ability to wash various loads. As a result, it would be useful if a user could have greater flexibility, particularly with regard to the type of agitation element that is used for any given washing operation or wash cycle. Therefore, it would be advantageous to provide a washing machine appliance or assembly wherein an agitation element (or portions thereof) could be readily removed between discrete washing operations or wash cycles (e.g., by a user without the use of any tools).

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a washing machine appliance is provided. The washing machine appliance may include a tub, a basket rotatably positioned within the tub, an impeller base, and an extended post. The impeller base may be rotatably mounted within the basket and define a rotation axis. The impeller base may include one or more impeller fins extending radially outward from the rotation axis and a mounting face disposed radially inward from the one or more impeller fins. The mounting face may include one or more dovetail joints extending vertically. The extended post may be removably attached to the impeller base to rotate therewith. The extended post may include a base body base body extending along the rotation axis between a bottom end proximal to the impeller base and a top end distal to the impeller base. The extended post may also include an auger fin extending radially from the base body between the bottom end and the top end. The extended post may further include a mating face disposed on the bottom end. The mating face may define one or more receiver slots corresponding to and selectively receiving the one or more dovetail joints.

In another exemplary aspect of the present disclosure, a washing machine appliance is provided. The washing machine appliance may include a tub, a basket rotatably positioned within the tub, an impeller base, an extended post, and a connector bar. The impeller base may be rotatably mounted within the basket and define a rotation axis. The impeller base may include one or more impeller fins extending radially outward from the rotation axis, a mounting face disposed radially inward from the one or more impeller fins, and a threaded bracket disposed on the mounting face and coaxial with the rotation axis. The extended post may include a base body extending along the rotation axis between a bottom end proximal to the impeller base and a top end distal to the impeller base. The base body may define an interior cavity from the bottom end to the top end. The extended post may also include an auger fin extending radially from the base body between the bottom end and the top end. The extended post may further include a mating face disposed on the bottom end against the mounting face. The connector bar may be selectively received within the interior cavity and extend along the rotation axis between a lower end and an upper end. The lower end may include a threaded joint complementary to the threaded bracket and selectively engaged therewith through the mating face. The upper end may include an enlarged handle held at the top end of the base body.

In yet another exemplary aspect of the present disclosure, an agitation element for a washing machine appliance is provided. The agitation element may include an impeller base, an extended post, a connector bar, and a post cap. The impeller base may define a rotation axis and include one or more impeller fins extending radially outward from the rotation axis, a mounting face disposed radially inward from the one or more impeller fins, and a threaded bracket disposed on the mounting face and coaxial with the rotation axis. The mounting face may include a plurality of dovetail joints extending vertically and circumferentially spaced apart about the rotation axis. The extended post may be removably attached to the impeller base to rotate therewith. The extended post may include a base body, an auger fin, and a mating face. The base body may extend along the rotation axis between a bottom end proximal to the impeller base and a top end distal to the impeller base. The base body may define an interior cavity from the bottom end to the top end. The auger fin may extend radially from the base body between the bottom end and the top end. The mating face may be disposed on the bottom end against the mounting face. The mating face may include a plurality of receiver slots corresponding to and selectively receiving the plurality of dovetail joints. The connector bar may be selectively received within the interior cavity and extend along the rotation axis between a lower end and an upper end. The lower end may include a threaded joint complementary to the threaded bracket and selectively engaged therewith through the mating face. The upper end may include an enlarged handle held at the top end of the base body. The post cap may be selectively covering the interior cavity of the extended post at the top end.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
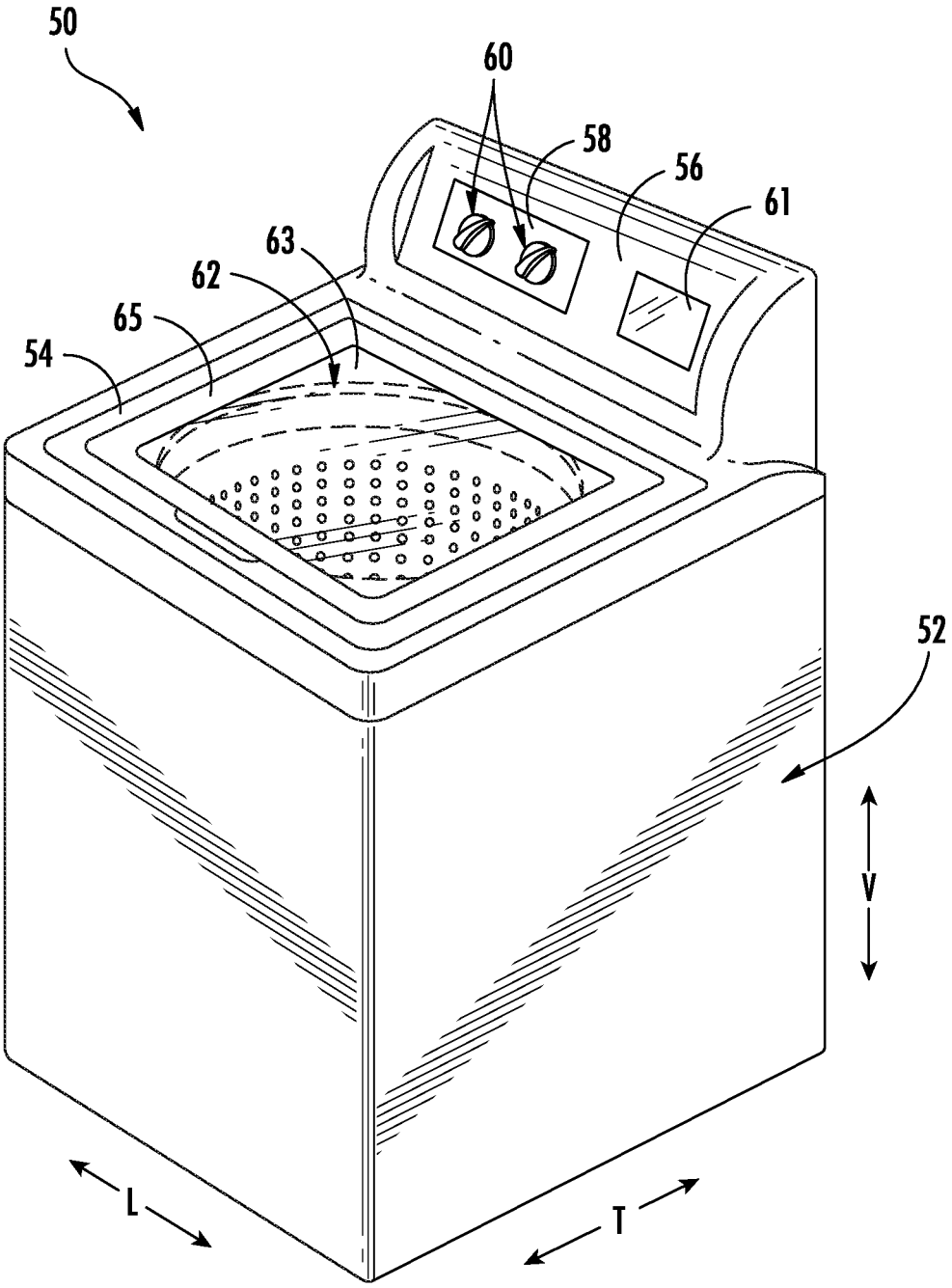
FIG. 1 provides a perspective view of a washing machine appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The phrase "in one embodiment," does not necessarily refer to the same embodiment, although it may. The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Figure 2:
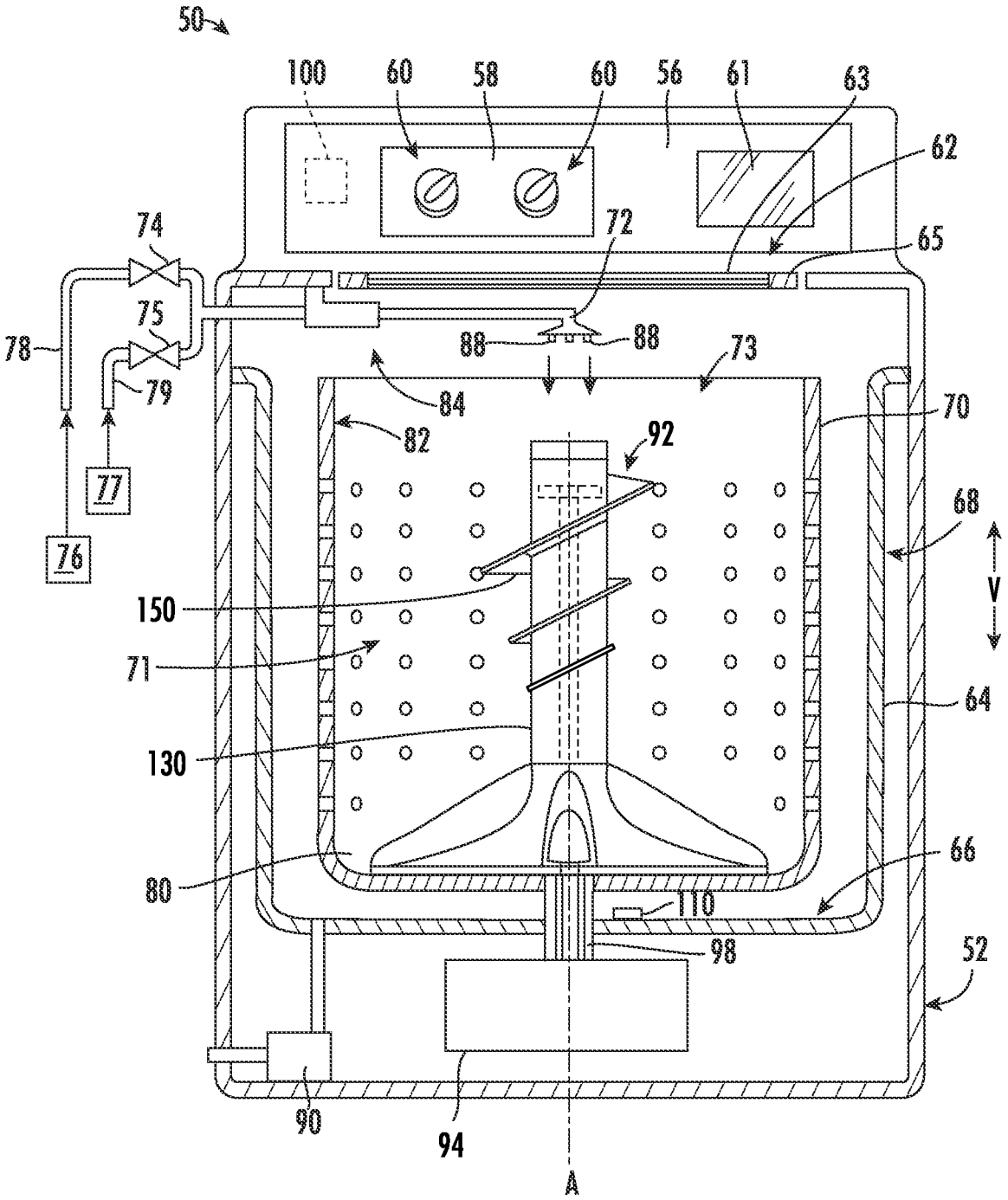
FIG. 2 provides a sectional elevation view of the exemplary washing machine appliance of FIG. 1.
Figure 3:
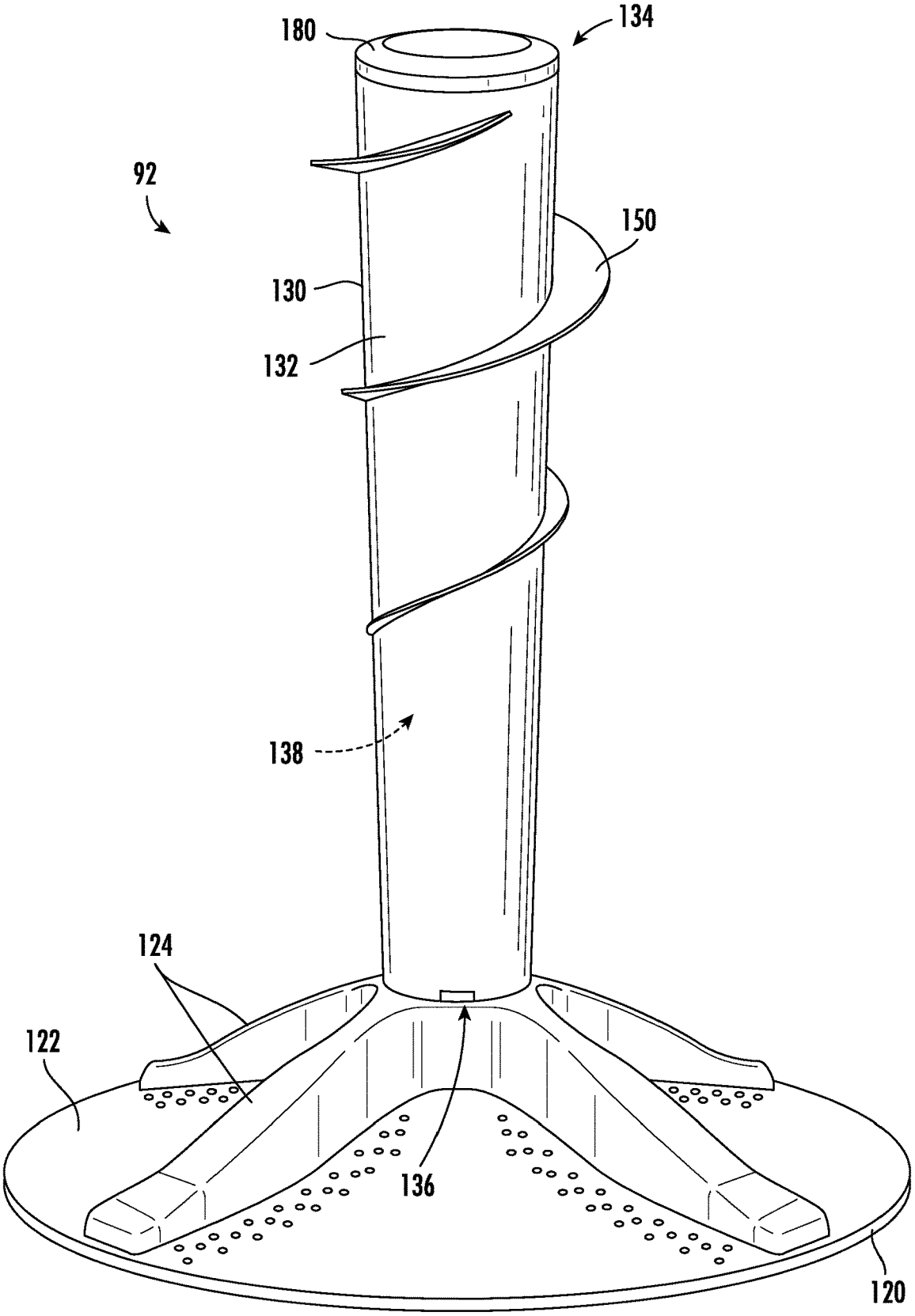
FIG. 3 provides a perspective view of an agitation element, in isolation, according to exemplary embodiments of the present disclosure.
Figure 4:
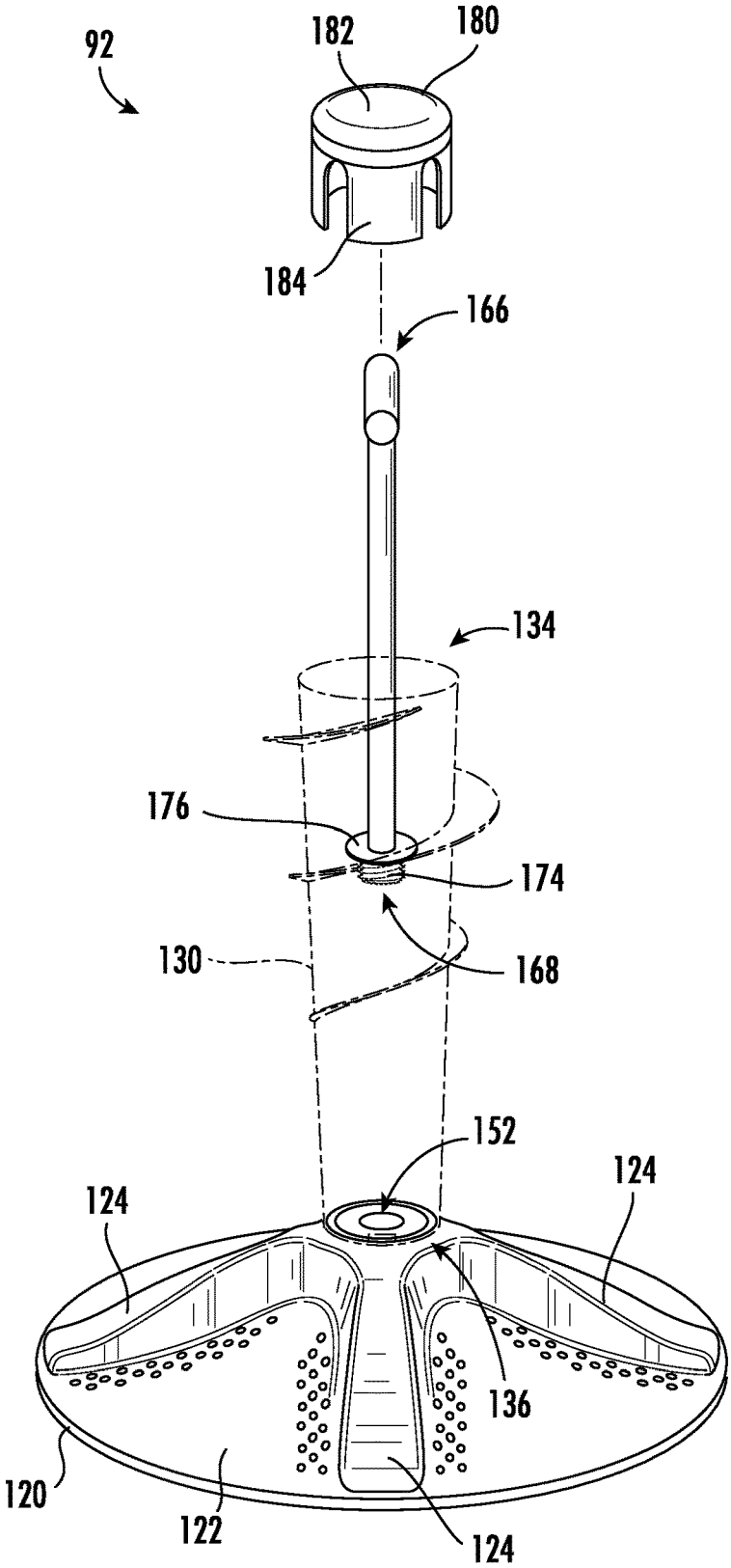
FIG. 4 provides an exploded perspective of the exemplary agitation element of FIG. 3.
Figure 5:
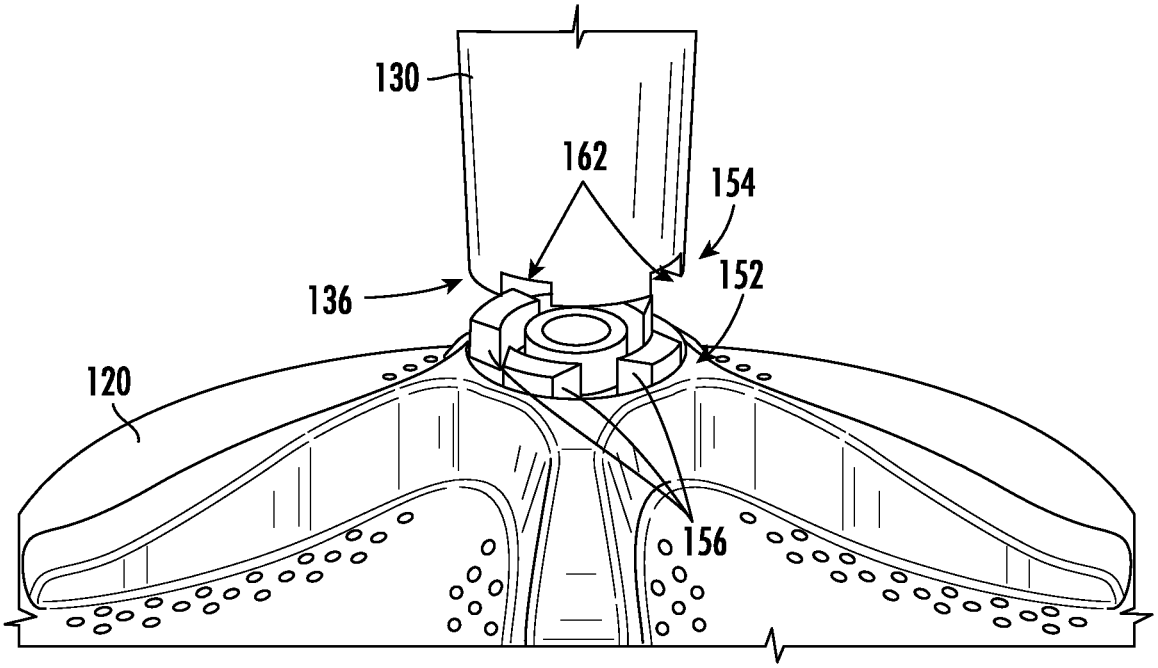
FIG. 5 provides a perspective view of a portion of the exemplary agitation element of FIG. 3, wherein the impeller base and the extended post have been separated.
Figure 6:
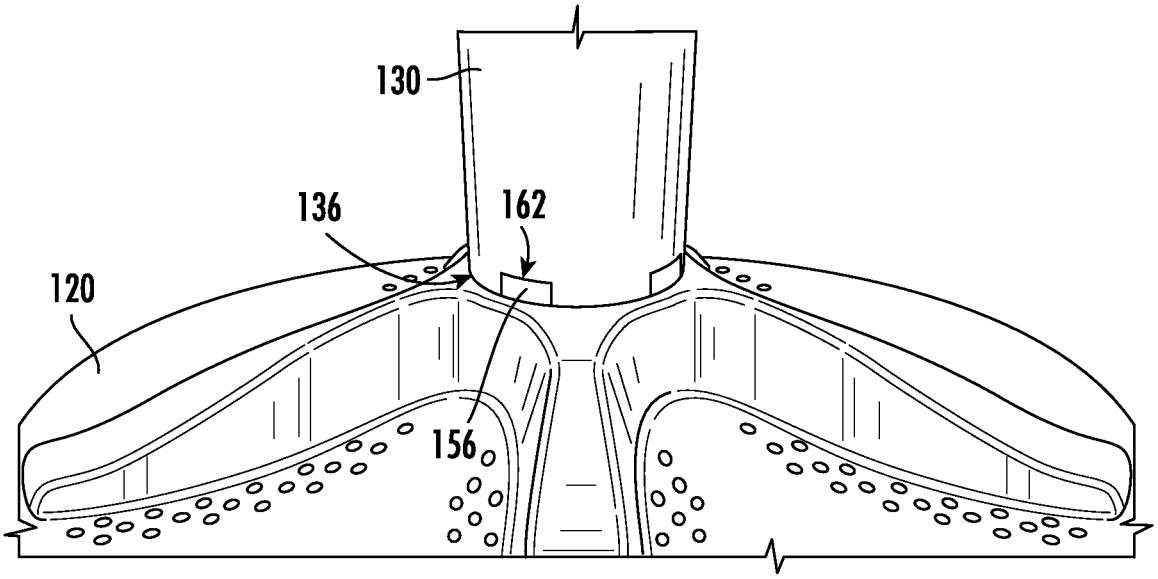
FIG. 6 provides a perspective view of a portion of the exemplary agitation element of FIG. 3, wherein the impeller base and the extended post have been connected.
Figure 7:
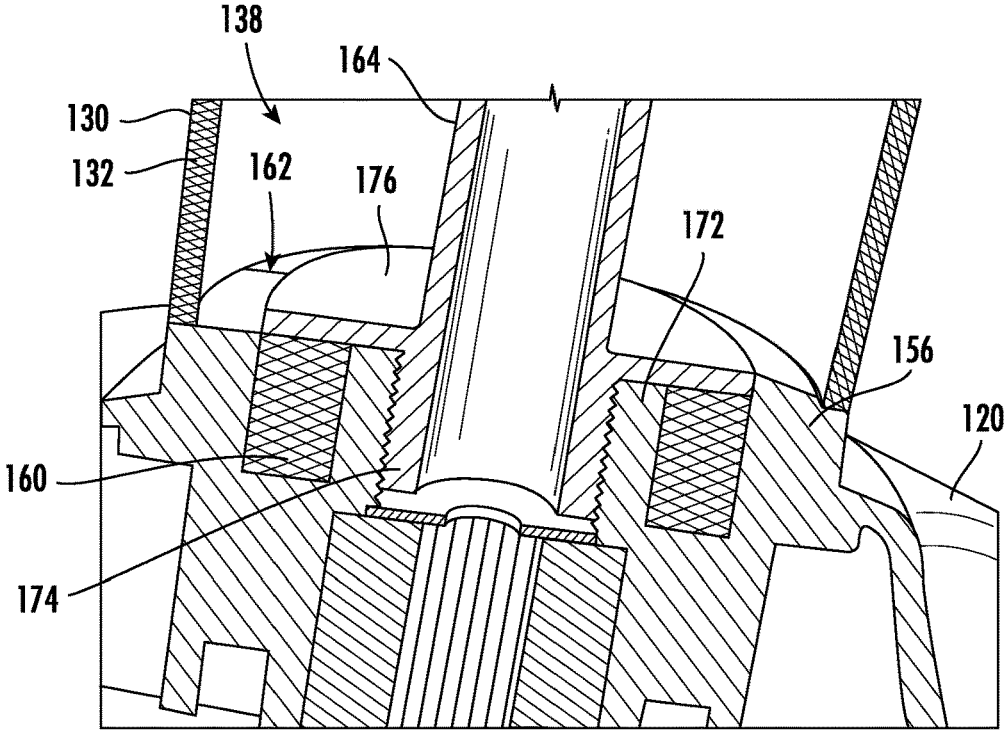
FIG. 7 provides a sectional perspective view of a portion of the exemplary agitation element of FIG. 3, wherein the impeller base and the extended post have been connected.
Figure 8:
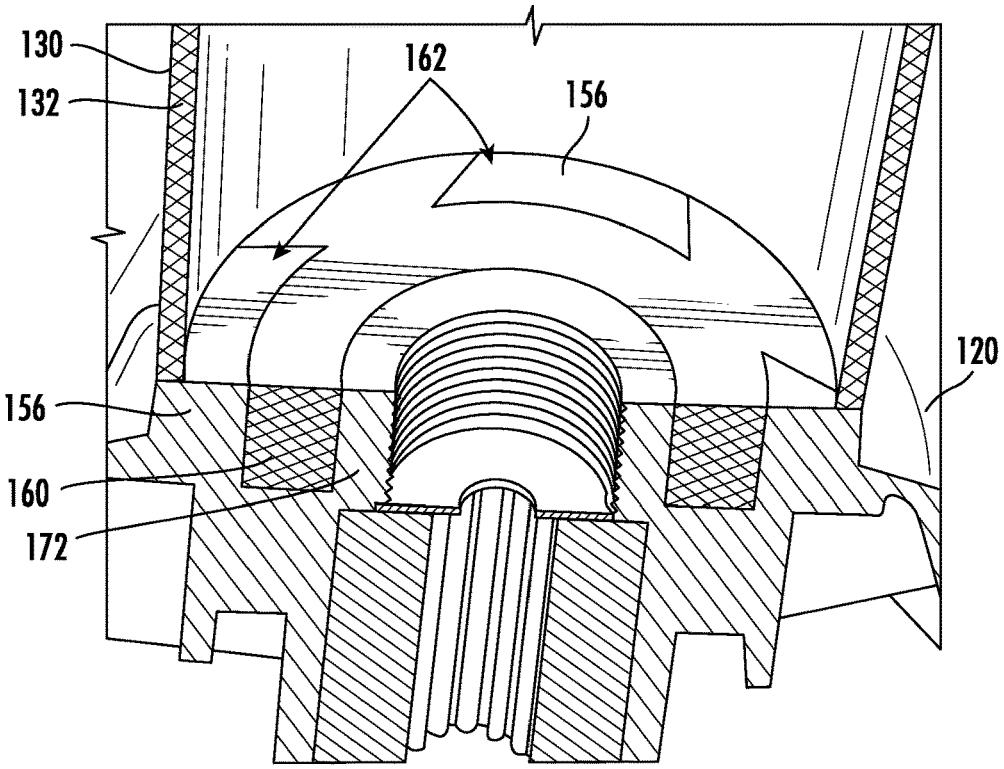
FIG. 8 provides a sectional perspective view of a portion of the exemplary agitation element of FIG. 3, wherein the connector bar has been removed for clarity.
Figure 9:
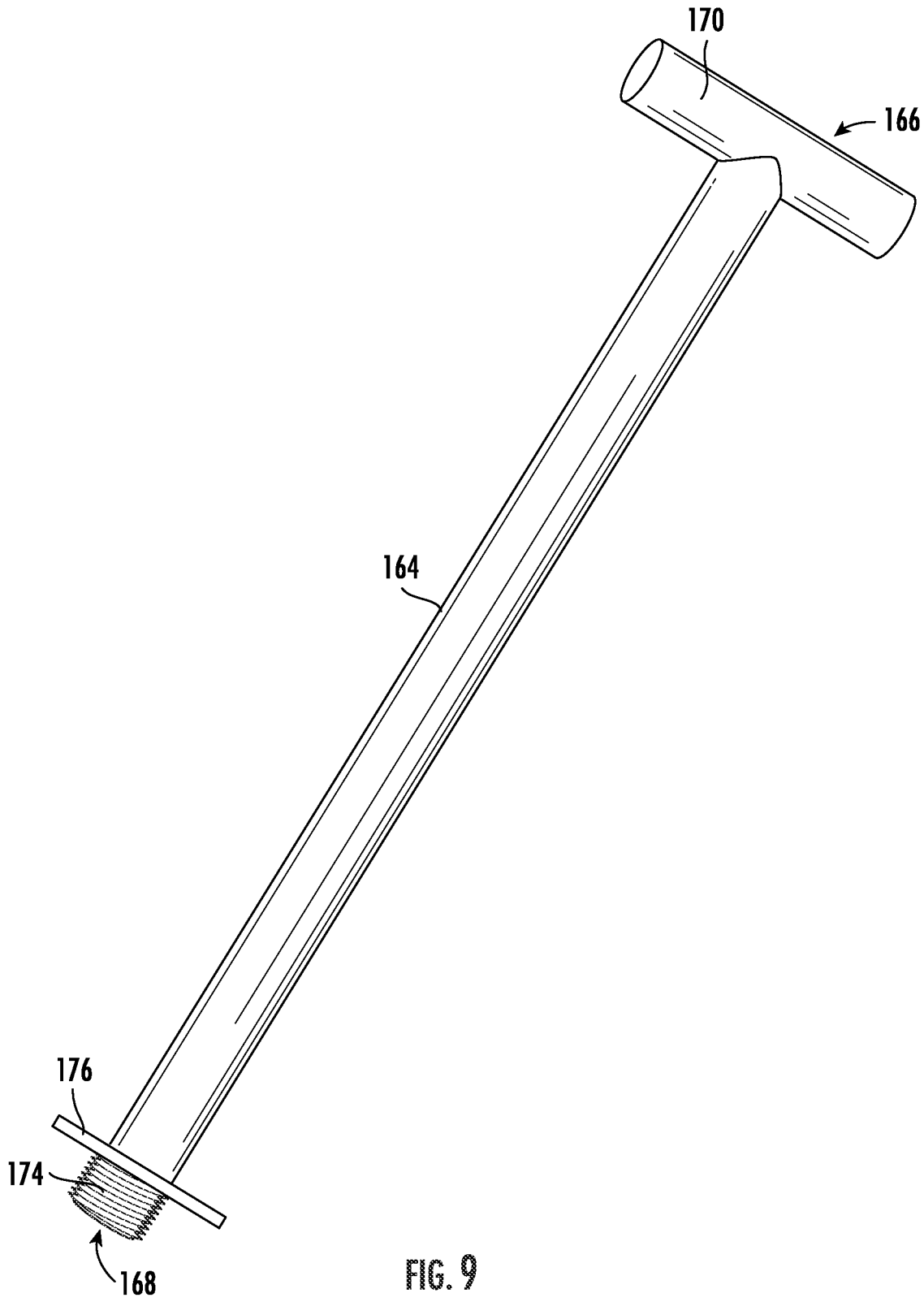
FIG. 9 provides a perspective view, in isolation, of the exemplary agitation element of FIG. 3, FIG. 10 provides a perspective view of a portion of the impeller base of the exemplary agitation element of FIG. 3.
Figure 10:
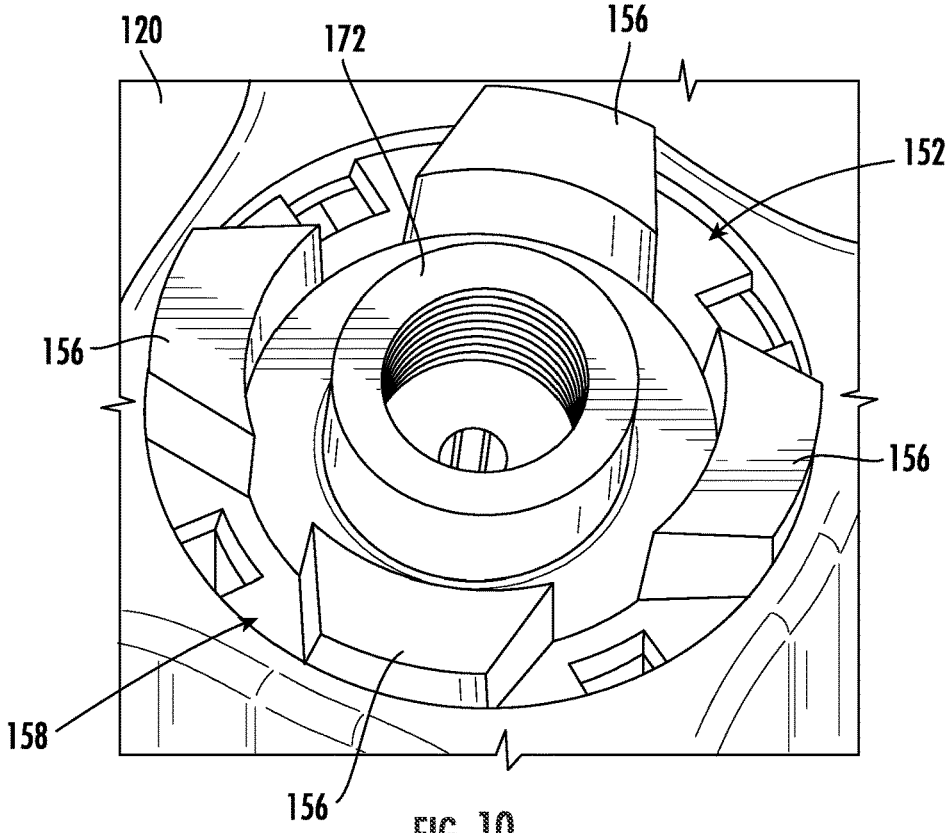
Figure 11:
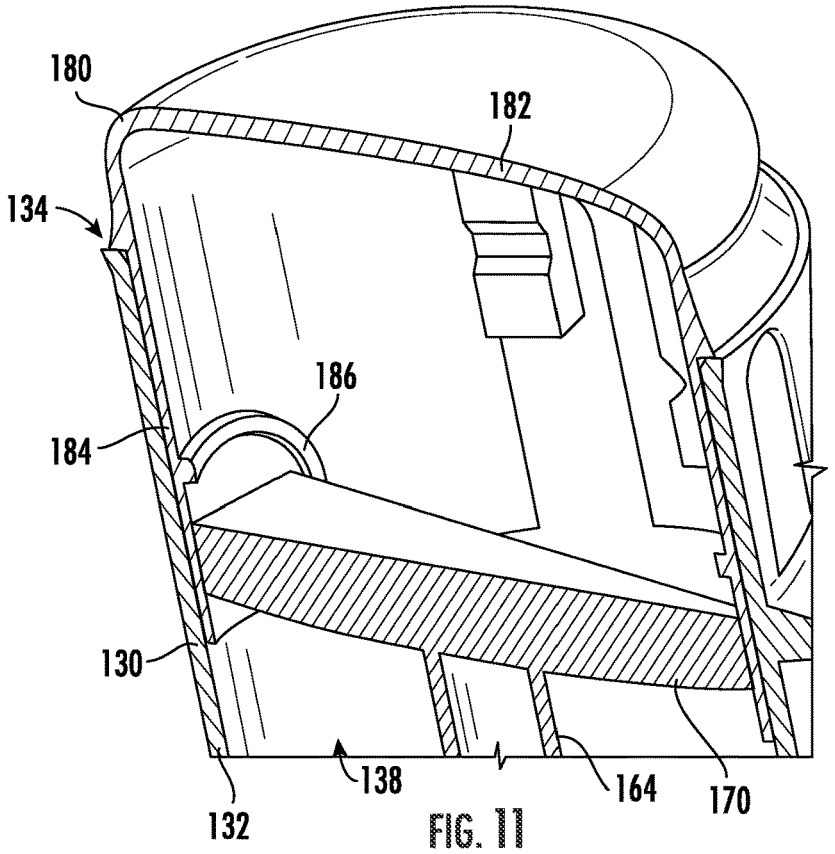
FIG. 11 provides a sectional perspective view of a portion of the exemplary agitation element of FIG. 3.

Turning now to the figures, FIGS. 1 and 2 provide separate views of a washing machine appliance 50 according to exemplary embodiments of the present disclosure. As shown, washing machine appliance 50 generally defines a vertical direction V, a lateral direction L, and a transverse direction T. The vertical direction V, lateral direction L, and transverse direction T are each mutually perpendicular and form an orthogonal direction system.

Washing machine appliance 50 may include a cabinet 52 and a cover 54. A backsplash 56 extends from cover 54, and a control panel 58, including a plurality of input selectors 60, is coupled to backsplash 56.

Control panel 58 and input selectors 60 collectively form a user interface input for operator selection of machine cycles and features, and in one embodiment, a display 61 indicates selected features, a countdown timer, or other items of interest to machine users. It should be appreciated, however, that in other exemplary embodiments, the control panel 58, input selectors 60, and display 61, may have any other suitable configuration. For example, in other exemplary embodiments, one or more of the input selectors 60 may be configured as manual "push-button" input selectors, or alternatively may be configured as a touchscreen (e.g., on display 61).

A lid 62 may be mounted to cover 54 and rotatable between an open position (not shown) facilitating access to a tub, also referred to as a wash tub, 64 located within cabinet 52 and a closed position (FIG. 1) forming an enclosure over tub 64. Lid 62 in exemplary embodiment includes a transparent panel 63, which may be formed of, for example, glass, plastic, or any other suitable material. The transparency of the panel 63 allows users to see through the panel 63, and into the tub 64 when the lid 62 is in the closed position. In some embodiments, the panel 63 itself can generally form the lid 62. In other embodiments, the lid 62 includes the panel 63 and a frame 65 surrounding and encasing the panel 63. Alternatively, panel 63 need not be transparent.

As may be seen in FIG. 2, tub 64 includes a bottom wall 66 and a sidewall 68. A wash drum or basket 70 is rotatably mounted within tub 64. In particular, basket 70 is rotatable about a central axis, which may when properly balanced and positioned in the embodiment illustrated be a vertical axis. Thus, washing machine appliance is generally referred to as a vertical axis washing machine appliance. Basket 70 defines a wash chamber 73 for receipt of articles for washing and extends, for example, vertically, between a bottom portion 80 and a top portion 82. Basket 70 includes a plurality of openings or perforations 71 therein to facilitate fluid communication between an interior of basket 70 and tub 64.

A nozzle 72 is configured for flowing a liquid into tub 64. In particular, nozzle 72 may be positioned at or adjacent to top portion 82 of basket 70. Nozzle 72 may be in fluid communication with one or more water sources 76, 77 in order to direct liquid (e.g. water) into tub 64 or onto articles within chamber 73 of basket 70. Nozzle 72 may further include apertures 88 through which water may be sprayed into the tub 64. Apertures 88 may, for example, be tubes extending from the nozzles 72 as illustrated, or simply holes defined in the nozzles 72 or any other suitable openings through which water may be sprayed. Nozzle 72 may additionally include other openings, holes, etc. (not shown) through which water may be flowed (i.e. sprayed or poured) into the tub 64.

Various valves may regulate the flow of fluid through nozzle 72. For example, a flow regulator may be provided to control a flow of hot or cold water into the wash chamber of washing machine appliance 50. For the embodiment depicted, the flow regulator includes a hot water valve 74 and a cold water valve 75. The hot and cold water valves 74, 75 are used to flow hot water and cold water, respectively, therethrough. Each valve 74, 75 can selectively adjust to a closed position in order to terminate or obstruct the flow of fluid therethrough to nozzle 72. The hot water valve 74 may be in fluid communication with a hot water source 76, which may be external to the washing machine appliance 50. The cold water valve 75 may be in fluid communication with a cold water source 77, which may be external to the washing machine appliance 50. The cold water source 77 may, for example, be a commercial water supply, while the hot water source 76 may be, for example, a water heater. Such water sources 76, 77 may supply water to the appliance 50 through the respective valves 74, 75. A hot water conduit 78 and a cold water conduit 79 may supply hot and cold water, respectively, from the sources 76, 77 through the respective valves 74, 75 and to the nozzle 72.

An additive dispenser 84 may additionally be provided for directing a wash additive, such as detergent, bleach, liquid fabric softener, etc., into the tub 64. For example, dispenser 84 may be in fluid communication with nozzle 72 such that water flowing through nozzle 72 flows through dispenser 84, mixing with wash additive at a desired time during operation to form a liquid or wash fluid, before being flowed into tub 64. For the embodiment depicted, nozzle 72 is a separate downstream component from dispenser 84. In other exemplary embodiments, however, nozzle 72 and dispenser 84 may be integral, with a portion of dispenser 84 serving as the nozzle 72, or alternatively dispenser 84 may be in fluid communication with only one of hot water valve 74 or cold water valve 75. In still other exemplary embodiments, the washing machine appliance 50 may not include a dispenser, in which case a user may add one or more wash additives directly to wash chamber 73. A pump assembly 90 (shown schematically in FIG. 2) is located beneath tub 64 and basket 70 for gravity assisted flow to drain tub 64.

As will be described in greater detail herein, an agitation element 92 is oriented to rotate about the rotation axis A (e.g., parallel to the vertical direction V). Generally, agitation element 92 includes an impeller base 120 and extended post 130. The agitation element 92 depicted is positioned within the basket 70 to impart motion to the articles and liquid in the chamber 73 of the basket 70. More particularly, the agitation element 92 depicted is provided to impart downward motion of the articles along the rotation axis A. For example, with such a configuration, during operation of the agitation element 92 the articles may be moved downwardly along the rotation axis A at a center of the basket 70, outwardly from the center of basket 70 at the bottom portion 80 of the basket 70, then upwardly along the rotation axis A towards the top portion 82 of the basket 70.

In optional embodiments, basket 70 and agitation element 92 are both driven by a motor 94. Motor 94 may, for example, be a pancake motor, direct drive brushless motor, induction motor, or other motor suitable for driving basket 70 and agitation element 92. As motor output shaft 98 is rotated, basket 70 and agitation element 92 are operated for rotatable movement within tub 64 (e.g., about rotation axis A). Washing machine appliance 50 may also include a brake assembly (not shown) selectively applied or released for respectively maintaining basket 70 in a stationary position within tub 64 or for allowing basket 70 to spin within tub 64.

Various sensors may additionally be included in the washing machine appliance 50. For example, a pressure sensor 110 may be positioned in the tub 64 as illustrated or, alternatively, may be remotely mounted in another location within the appliance 50 and be operationally connected to tub 64 by a hose (not shown). Any suitable pressure sensor 110, such as an electronic sensor, a manometer, or another suitable gauge or sensor, may be used. The pressure sensor 110 may generally measure the pressure of water in the tub 64. This pressure can then be used to estimate the height or amount of water in the tub 64. Additionally, a suitable speed sensor can be connected to the motor 94, such as to the output shaft 98 thereof, to measure speed and indicate operation of the motor 94. Other suitable sensors, such as temperature sensors, water sensors, moisture sensors, etc., may additionally be provided in the washing machine appliance 50.

Operation of washing machine appliance 50 is controlled by a processing device or controller 100, that is operatively coupled to the input selectors 60 located on washing machine backsplash 56 for user manipulation to select washing machine cycles and features. Controller 100 may further be operatively coupled to various other components of appliance 50, such as the flow regulator (including valves 74, 75), motor 94, pressure sensor 110, other suitable sensors, etc. In response to user manipulation of the input selectors 60, controller 100 may operate the various components of washing machine appliance 50 to execute selected machine cycles and features.

While described in the context of specific embodiments of washing machine appliance 50, using the teachings disclosed herein it will be understood that washing machine appliance 50 is provided by way of example only. Other washing machine appliances having different configurations, different appearances, or different features may also be used with the present subject matter as well.

Turning now generally to FIGS. 2 through 11, agitation element 92 may include or be provided as a removable agitation element having an extended post 130 selectively attached to (and removable from) impeller base 120. Generally, impeller base 120 includes an impeller platform 122 having one or more impeller fins 124 extending therefrom, as would generally be understood. In the illustrated embodiments, impeller base 120 includes four discrete impeller fins 124 that extends upward from impeller platform 122 and radially outward from rotation axis A. Nonetheless, it is understood that any suitable number of impeller fins 124 may be provided. When assembled, impeller base 120 is generally connected to or in mechanical communication with motor 94, such as through the output shaft 98. Thus, impeller base 120 may be rotated, oscillated, or otherwise motivated by motor 94 (e.g., during a washing operation or wash cycle, as directed by controller 100).

When assembled, extended post 130 may generally extend along the rotation axis A above the impeller base 120. Specifically, extended post 130 may include a base body 132 extending along the rotation axis A between a bottom end 136 and a top end 134. As shown, base body 132 may be mounted within wash chamber 73 such that bottom end 136 is attached or otherwise proximal to the impeller base 120 while top end 134 is held distal to impeller base 120. Between top end 134 and bottom end 136, one or more auger fins 150 may extend radially from extended post 130 (e.g., to engage and agitate articles within wash chamber 73). In the illustrated embodiments, auger fin 150 is formed as a helical coil wrapped about extended post 130. Nonetheless, any suitable shape or number of auger fins may be provided in alternative embodiments, as would be understood.

Turning especially to FIGS. 5 through 8 and 10, impeller base 120 may provide a mounting face 152 that selectively connects to a mating face 154 of extended post 130. As shown, mounting face 152 is disposed inward from the impeller fins 124. Thus, mounting face 152 may be located closer to rotation axis A than impeller fins 124. In some such embodiments, mounting face 152 is generally coaxial with rotation axis A (e.g., at a radial center of impeller base 120). At or within mounting face 152, impeller base 120 may include or more dovetail joints 156 that extending vertically, such as upward from a top surface of base body 132 toward extended post 130 or the opening of wash chamber 73. Optionally, multiple dovetail joints 156 may be circumferentially spaced apart from each other about the rotation axis A. Additionally or alternatively, multiple dovetail joints 156 may be provided at a common (e.g., the same) radial distance from rotation axis A. In exemplary embodiments, mounting face 152 defines a recessed cup 158 directed upward such that the recessed cup 158 is open to receive, for instance, a portion of extended post 130 (e.g., a continuous faceplate 160) from above. In some such embodiments, the dovetail joints 156 are disposed within the recessed cup 158. Thus, the dovetail joints 156 may extend upward as discrete teeth within the cavity of the recessed cup 158.

Extended post 130 may provide a complementary structure to engage or interlock with the mounting face 152 of impeller base 120. In some embodiments, extended post 130 includes a mating face 154 disposed on bottom end 136 to rest against or interlock with the mounting face 152. Specifically, mating face 154 may define one or more receiver slots 162 to receive the dovetail joints 156. For instance, mating face 154 may define a plurality of receiver slots 162 that correspond to the dovetail joints 156 and selectively receive the same. Thus, each dovetail joint 156 may correspond to a discrete receiver slot 162. Optionally, mating face 154 may include a continuous faceplate 160 that extends (e.g., horizontally) across the bottom end 136. Continuous faceplate 160, in particular, may define the receiver slots 162. For instance, the receiver slots 162 may extend vertically through continuous faceplate 160, such as to an interior cavity 138 defined by extended post 130. When assembled such that extended post 130 is attached to impeller base 120, each dovetail joint 156 may be selectively held within a discrete receiver slot 162. Advantageously, engagement between the dovetail joints 156 and receiver slots 162 may selectively and rotationally fix extended post 130 to impeller base 120. Moreover, the connection between the mounting face 152 and mating face 154 may notably resist side loads (e.g., generated by articles within wash chamber 73) and maintain the position of extended post 130 relative to impeller base 120.

Turning especially to FIGS. 2, 4, and 8 through 11, a connector bar 164 may be provided to selectively restrict vertical movement of extended post 130 relative to impeller base 120. As shown, connector bar 164 may be disposed generally along the rotation axis A from a lower end 168 and an upper end 166. When extended post 130 is attached to impeller base 120, connector bar 164 may be received within an interior cavity 138 defined by base body 132. Moreover, lower end 168 may be disposed proximal to the impeller base 120 while upper end 166 is disposed above lower end 168, distal to impeller base 120. In some such embodiments, upper end 166 may be held at substantially (e.g., within ten percent variance of) the same height or vertical location as the top end 134 of base body 132. In other words, upper end 166 may be disposed at the top end 134. In additional or alternative embodiments, an enlarged handle 170 of connector bar 164 is formed on upper end 166 (e.g., to be held at top end 134). Optionally, enlarged handle 170 may be formed as a horizontal rail extending outward from a vertical rail of connector bar 164 (e.g., such that connector bar 164 is T-shaped at upper end 166).

Attaching connector bar 164 and extended post 130 to impeller base 120 may require engaging connector bar 164 with at least a portion of mounting face 152. In some embodiments, impeller base 120 includes a threaded bracket 172 disposed on mounting face 152. As shown, threaded bracket 172 may be coaxial with the rotation axis A, thus providing a set of helical threads about the rotation axis A. A threaded joint 174 that is complementary to the threaded bracket 172 may be included on the lower end 168 of connector bar 164. Thus, the threaded joint 174 may be selectively screwed into or held in engagement with the threaded bracket 172. Optionally, threaded joint 174 may be engaged with threaded bracket 172 through the mating face 154. For instance, continuous faceplate 160 may define a central aperture (e.g., coaxial with rotation axis A or radially inward and apart from the receiver slots 162) through which threaded joint 174 extends or otherwise engages threaded bracket 172. A radial flange 176 disposed above threaded joint 174 may be held against a top-facing surface of continuous faceplate 160. In turn, the connection between the mounting face 152 and mating face 154 may notably resist vertical loads (e.g., generated by articles within wash chamber 73) and maintain the vertical position of extended post 130 relative to impeller base 120.

In certain embodiments, a post cap 180 is included with agitation element 92. As shown, post cap 180 may be placed on base body 132 (e.g., at top end 134) and cover interior cavity 138. Thus, when assembled, connector bar 164 and the rest of interior cavity 138 may generally be hidden from a user's view. In some embodiments, post cap 180 includes an upper cap wall 182 (e.g., extending across rotation axis A above interior cavity 138) and a side cap wall 184 extending downward from upper cap wall 182 (e.g., to be held against or within base body 132). Side cap wall 184 may be complementary to an interior surface of base body 132 or may otherwise include one or more mechanical fasteners (e.g., tabs, clips, shoulders, etc.) to rotationally fix post cap 180 relative to base body 132. In turn, during use, post cap 180 may be attached to extended post 130 in rotationally fixed engagement. When placed on base body 132, side cap wall 184 may thus be prevented from rotating relative to the rest of extended post 130.

Optionally, at least a portion of side cap wall 184 may form an interior stop or rotation brake 186 to engage connector bar 164. For instance, rotation brake 186 may extend radially inward at a common vertical height with enlarged handle 170. When assembled such that extended post 130 is attached to impeller base 120, post cap 180 may be held against the enlarged handle 170. Specifically, rotation brake 186 may circumferentially obstruct rotation of enlarged handle 170. This engagement may rotationally restrict the connector bar 164. Thus, post cap 180 may advantageously prevent connector bar 164 from being inadvertently unscrewed or separated from impeller base 120 (e.g., during rotation of agitation element 92).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance comprising:

a tub;

a basket rotatably positioned within the tub;

an impeller base rotatably mounted within the basket and defining a rotation axis, the impeller base comprising one or more impeller fins extending radially outward from the rotation axis, and a mounting face disposed radially inward from the one or more impeller fins, the mounting face comprising one or more dovetail joints extending vertically; and an extended post removably attached to the impeller base to rotate therewith, the extended post comprising a base body extending along the rotation axis between a bottom end proximal to the impeller base and a top end distal to the impeller base, an auger fin extending radially from the base body between the bottom end and the top end, and a mating face disposed on the bottom end, the mating face defining one or more receiver slots corresponding to and selectively receiving the one or more dovetail joints, wherein the impeller base further comprises a threaded bracket disposed on the mounting face and coaxial with the rotation axis, and wherein the washing machine appliance further comprising a connector bar selectively received within a hollow interior cavity of the extended post and extending along the rotation axis between a lower end and an upper end, the lower end comprising a threaded joint complementary to the threaded bracket and selectively engaged therewith through the mating face, the upper end comprising an enlarged handle held at the top end of the base body.

2. The washing machine appliance of claim 1, wherein the one or more dovetail joints comprises a plurality of dovetail joints circumferentially spaced apart about the rotation axis.

3. The washing machine appliance of claim 1, wherein the mounting face defines a recessed cup directed upward, and wherein the one or more dovetail joints are disposed within the recessed cup.

4. The washing machine appliance of claim 1, wherein the mating face further comprises a continuous faceplate, and wherein the receiver slots are defined vertically through the continuous faceplate.

5. The washing machine appliance of claim 1, further comprising a post cap selectively covering the hollow interior cavity of the extended post at the top end.

6. The washing machine appliance of claim 5, wherein the post cap is held against the enlarged handle to rotationally restrict the connector bar.

7. The washing machine appliance of claim 6, wherein the post cap is selectively attached to the extended post in rotationally fixed engagement therewith.

8. A washing machine appliance comprising:

a tub;

a basket rotatably positioned within the tub;

an impeller base rotatably mounted within the basket and defining a rotation axis, the impeller base comprising one or more impeller fins extending radially outward from the rotation axis, a mounting face disposed radially inward from the one or more impeller fins, and a threaded bracket disposed on the mounting face and coaxial with the rotation axis;

an extended post removably attached to the impeller base to rotate therewith, the extended post comprising a base body extending along the rotation axis between a bottom end proximal to the impeller base and a top end distal to the impeller base, the base body defining an interior cavity extending fully through the base body along the rotation axis from the bottom end to the top end, an auger fin extending radially from the base body between the bottom end and the top end, and a mating face disposed on the bottom end against the mounting face, the mating face comprising a continuous faceplate extending radially inward from the base body; and a connector bar selectively received within the interior cavity and comprising a vertical rail extending along the rotation axis between a lower end and an upper end, the lower end comprising a threaded joint complementary to the threaded bracket and selectively engaged therewith through the mating face, the upper end comprising an enlarged handle held at the top end of the base body, the connector bar further comprising a radial flange extending radially outward from the vertical rail above the threaded joint and below the enlarged handle, the radial flange being held against a top-facing surface of the continuous faceplate.

9. The washing machine appliance of claim 8, wherein the mounting face comprises a plurality of dovetail joints extending vertically and circumferentially spaced apart about the rotation axis, and wherein the mating face defines a plurality of receiver slots corresponding to and selectively receiving the plurality of dovetail joints.

10. The washing machine appliance of claim 9, wherein the mounting face defines a recessed cup directed upward, and wherein the one or more dovetail joints are disposed within the recessed cup.

11. The washing machine appliance of claim 9, wherein the receiver slots are defined vertically through the continuous faceplate.

12. The washing machine appliance of claim 8, further comprising a post cap selectively covering the interior cavity of the extended post at the top end.

13. The washing machine appliance of claim 12, wherein the post cap is held against the enlarged handle to rotationally restrict the connector bar.

14. The washing machine appliance of claim 13, wherein the post cap is selectively attached to the extended post in rotationally fixed engagement therewith.

15. The washing machine appliance of claim 8, wherein the vertical rail extends along the rotation axis from the impeller base and thereabove, the vertical rail being circumferentially surrounded by the base body.

16. An agitation element mountable within a washing machine appliance, the agitation element comprising:

an impeller base rotatably defining a rotation axis, the impeller base comprising one or more impeller fins extending radially outward from the rotation axis, a mounting face disposed radially inward from the one or more impeller fins, the mounting face comprising a plurality of dovetail joints extending vertically and circumferentially spaced apart about the rotation axis, and a threaded bracket disposed on the mounting face and coaxial with the rotation axis;

an extended post removably attached to the impeller base to rotate therewith, the extended post comprising a base body extending along the rotation axis between a bottom end proximal to the impeller base and a top end distal to the impeller base, the base body defining an interior cavity from the bottom end to the top end, an auger fin extending radially from the base body between the bottom end and the top end, and a mating face disposed on the bottom end against the mounting face, the mating face comprising a plurality of receiver slots corresponding to and selectively receiving the plurality of dovetail joints;

a connector bar selectively received within the interior cavity and extending along the rotation axis between a lower end and an upper end, the lower end comprising a threaded joint complementary to the threaded bracket and selectively engaged therewith through the mating face, the upper end comprising an enlarged handle held at the top end of the base body; and a post cap selectively covering the interior cavity of the extended post at the top end.

17. The agitation element of claim 16, wherein the mounting face defines a recessed cup directed upward, and wherein the one or more dovetail joints are disposed within the recessed cup.

18. The agitation element of claim 16, wherein the mating face further comprises a continuous faceplate, and wherein the receiver slots are defined vertically through the continuous faceplate.

19. The agitation element of claim 16, wherein the post cap is held against the enlarged handle to rotationally restrict the connector bar.

20. The agitation element of claim 19, wherein the post cap is selectively attached to the extended post in rotationally fixed engagement therewith.

* * * * *